US012677924B2

(12) United States Patent
Raymond et al.

(10) Patent No.: US 12,677,924 B2
(45) Date of Patent: Jul. 14, 2026

(54) DISPENSING HEAD FOR SHAVING FOAM

(71) Applicants: Paul Raymond, St. George's (CA); Giles Raymond, Lethbridge (CA); Daniel Wesley, Winnipeg (CA)

(72) Inventors: Paul Raymond, St. George's (CA); Giles Raymond, Lethbridge (CA); Daniel Wesley, Winnipeg (CA)

( * ) Notice: Subject to any disclaimer, the term of this patent is extended or adjusted under 35 U.S.C. 154(b) by 123 days.

(21) Appl. No.: 18/633,763

(22) Filed: Apr. 12, 2024

(65) Prior Publication Data

US 2024/0349865 A1 Oct. 24, 2024

Related U.S. Application Data

(60) Provisional application No. 63/514,893, filed on Jul. 21, 2023, provisional application No. 63/496,734, filed on Apr. 18, 2023.

(51) Int. Cl.
*A45D 27/04* (2006.01)
*A45D 27/06* (2006.01)
*A45D 40/00* (2006.01)

(52) U.S. Cl.
CPC ..... *A45D 27/04* (2013.01); *A45D 27/06* (2013.01); *A45D 40/0081* (2013.01)

(58) Field of Classification Search
CPC .... A45D 27/04; A45D 27/06; A45D 40/0081; A45D 2200/057; A45D 34/00
See application file for complete search history.

(56) References Cited

U.S. PATENT DOCUMENTS 3,302,235 A * 2/1967 Gerber ..... B65D 83/285 15/245.1
7,322,945 B2 * 1/2008 Dunmore ..... A61H 7/005 601/17
11,241,804 B2 * 2/2022 Godlieb ..... B26B 19/16
2001/0015016 A1 * 8/2001 Pragt ..... B26B 21/00 30/34.2
2002/0029478 A1 * 3/2002 Haws ..... B26B 21/446 30/41.5

(Continued)

OTHER PUBLICATIONS

PCT written opinion, dated Jun. 20, 2024, applicant Paul Raymond et al.

(Continued)

*Primary Examiner* — Khaled Annis
(74) *Attorney, Agent, or Firm* — Adrian D. Battison; Ryan W. Dupuis; Ade & Company Inc.

(57) ABSTRACT

A dispensing head for application of shave lubricating material such as foam, gel or lotion to the skin of a user includes a spreading blade portion with a flexible blade with a concave spreading surface and an outer spreading edge. A dose of the material is applied to the blade from a source to be released from the spreading edge for spreading between the spreading surface and the skin. Dimples on the spreading surface hold it away from the skin. The spreading blade portion is generally fan shaped with side edges extending outwardly from an inner edge to an arcuate outer edge at the spreading edge A vibration motor located behind the spreading surface for vibrating the spreading surface and the spreading edge thereon is provided to assist in spreading the material.

18 Claims, 6 Drawing Sheets

(56) References Cited

U.S. PATENT DOCUMENTS

| | | | | |
|---|---|---|---|---|
| 2003/0033717 | A1* | 2/2003 | Cecil | B26B 21/527 30/526 |
| 2005/0107724 | A1* | 5/2005 | Dunmore | A61H 15/02 601/72 |
| 2006/0254056 | A1* | 11/2006 | Coffin | B26B 21/44 30/41 |
| 2008/0196740 | A1* | 8/2008 | Velho | A45D 27/04 132/289 |
| 2008/0289185 | A1* | 11/2008 | Clarke | B26B 21/4056 30/41 |
| 2009/0126197 | A1* | 5/2009 | Tomassetti | B26B 21/446 30/526 |
| 2012/0102744 | A1* | 5/2012 | Forsdike | B26B 21/446 30/41 |
| 2014/0161504 | A1* | 6/2014 | Duquet | A45D 34/04 401/265 |
| 2021/0249795 | A1* | 8/2021 | Laghi | B05B 9/002 |
| 2024/0349865 | A1* | 10/2024 | Raymond | A45D 27/04 |

OTHER PUBLICATIONS

International search report, International application No. PCT/CA2024/050468, applicant Paul Raymond et al.

* cited by examiner

DISPENSING HEAD FOR SHAVING FOAM

This application claims the benefit under 35 USC 119(e) of Provisional Application 63/496,734 filed Apr. 14 21 3023 and of Provisional Application 63/514,893 filed Jul. 21 3023.

This invention relates to a dispensing head for attachment to a source of shaving foam for application of the shaving foam to the skin of a user.

BACKGROUND OF THE INVENTION

Many arrangements have been provided for assisting in application of shaving foam to the skin of the user. In some cases, these can comprise a simple brush where the foam is communicated to the brush as the brush is moved across the skin. In other cases, a massaging component is provided which can rotate to apply forces to the skin as the foam is applied to the skin through a channel at the rotating component.

SUMMARY OF THE INVENTION

According to the invention there is provided a dispensing head for application of shave lubricating material to the skin of a user prior to shaving, the dispensing head comprising:

a spreading blade portion;

the spreading blade portion having a flexible blade with a concave spreading surface on one side of the flexible blade and with an outer spreading edge;

a source of the shave lubricating material for communicating the shave lubricating material to the spreading surface of the flexible blade so that the shave lubricating material is located on the spreading surface at a position spaced from the spreading edge for spreading between the spreading surface and the skin and for release from the spreading edge.

According to the invention there is provided a dispensing head for application of shave lubricating material to the skin of a user prior to shaving, the dispensing head comprising:

a spreading blade portion;

the spreading blade portion having a flexible blade with a concave spreading surface on one side of the flexible blade and with an outer spreading edge;

a pad of shave lubricating lotion mounted on the spreading blade portion;

and a vibration motor for vibrating the spreading surface and the spreading edge thereon to assist in spreading the shave lubricating lotion as the spreading surface is moved over the skin.

According to the invention there is provided a dispensing head for attachment to a source of shave lubricating material for application of the shave lubricating material to the skin of a user, the dispensing head comprising:

an attachment portion for engaging onto the source;

a blade portion having a flexible blade with a spreading surface with an outer spreading edge;

a mounting connecting the attachment portion and the blade portion;

a dispensing channel in the head for communicating the shave lubricating material from the source to the spreading surface of the blade portion so that the shave lubricating material is applied onto the spreading surface for spreading between the spreading surface and the skin and for release from the spreading edge; and a vibration motor for vibrating the spreading surface and the spreading edge thereon to assist in spreading the shave lubricating material as the spreading surface is moved over the skin.

The dispensing head is primarily designed for shaving foam or gel to be applied to the skin typically to the face but can be used on other locations on the body of the user or can be used for dispensing material other than for shaving.

Preferably the spreading surface is concave so that the foam is discharged onto the concave surface.

Preferably the spreading surface has an inner edge and defines a continuous surface extending from the inner edge outwardly to the outer spreading edge.

Preferably the foam is discharged onto the spreading surface at a position adjacent the inner edge.

Preferably the foam is discharged onto the spreading surface through a slot adjacent the inner edge and extending across the inner edge.

Preferably the spreading surface includes a row of dimples adjacent the spreading edge to hold the spreading surface away from the face and thus form a layer of foam to be applied to the face at the dimples.

Preferably the source comprises a can having a dispensing nozzle and actuating valve for discharging the foam through the nozzle and wherein the attachment portion is arranged to engage onto the can at the nozzle to receive the foam into the channel and to allow access to the valve for manual operation.

Preferably the dispensing surface is generally fan shaped with side edges extending outwardly from an inner edge adjacent the channel to an arcuate outer edge at the spreading edge.

Preferably the vibration motor is located behind the dispensing surface.

Preferably the dispensing surface is formed from a body of flexible material.

Preferably the vibration motor is encased in an enclosure in the body.

Preferably the body includes charging terminals for recharging a battery of the vibration motor.

In one option there is provided a heater for applying heat to the foam prior to application to the skin of the user. In that option the heater can be located on the blade portion for applying heat to the foam prior to or simultaneously with application to the skin of the user. However the heater can be located in the passage from the can to the blade to heat the foam prior to its application or at any other suitable location.

The arrangement herein can provide one or more of the following features:

1. Fits onto standard shaving cream cans
2. Dispensing guard to help control the flow of shaving cream and reduce waste
3. Flexible dispensing head that contours to the body and face to evenly spread the shaving cream
4. Vibrating function to provide a relaxing massage
5. Stimulates hair follicles for a closer shave
6. Rechargeable battery for convenience
7. Waterproof design for easy cleaning and use in the shower
8. Made from non-toxic, BPA-free silicone material for use on all skin types The arrangement herein can provide one or more of the following benefits 1. Saves money by reducing the amount of wasted shaving cream due to over applying 2. Provides a more comfortable and even application of shaving cream while keeping hands clean
3. Eliminates mess and waste with easy rinse and no-cleanup design
4. Reduces the risk of irritation and razor burn by stimulating hair follicles and helping to provide a closer shave
5. Provides a relaxing massage before shaving
6. Suitable for all genders and all locations
7. Waterproof and rechargeable offering a hassle-free and uninterrupted shaving experience
8. Easy to attach and detach from shaving cream can, making it user-friendly and practical
9. Applicator helps user identify sensitive skin or uneven surface due to acne and pimples for a safer shave

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

A dispensing head 10 is provided for attachment to a source 11 such as a can of shaving foam for application of the shaving foam to the skin, for example, the face of a user.

Figure 1:
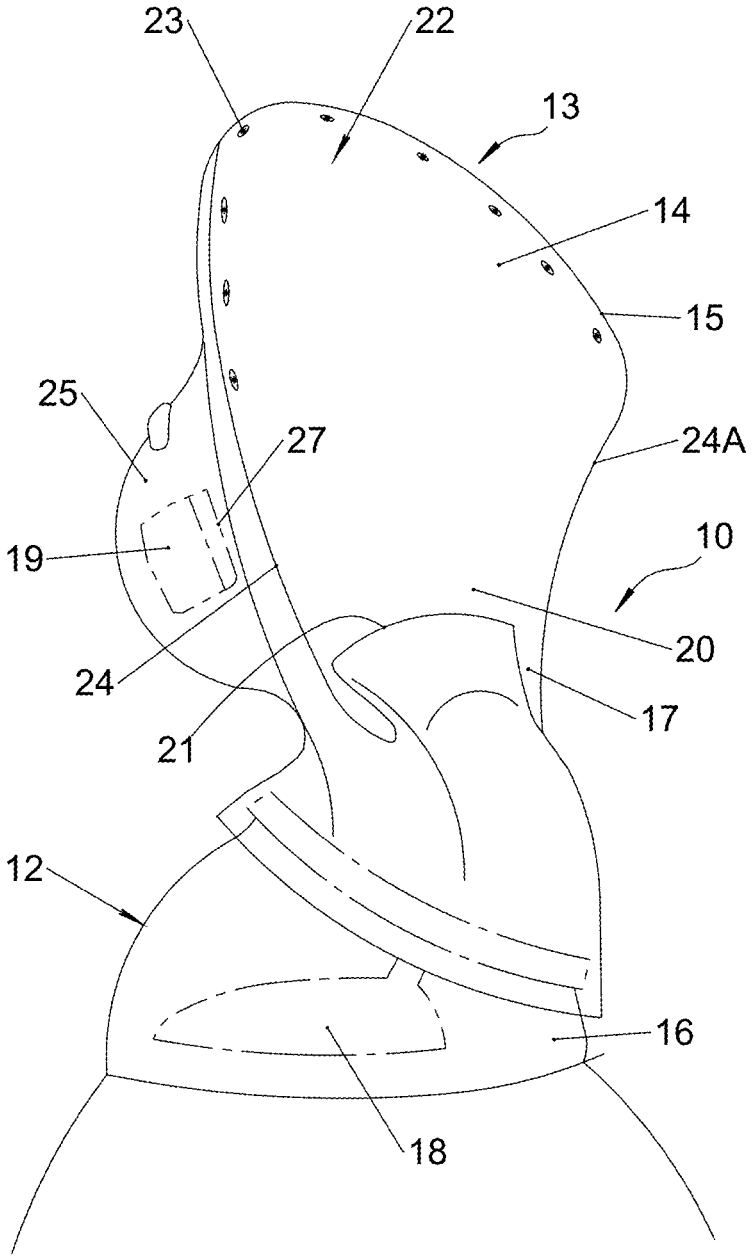
FIG. 1 is an isometric view of the dispensing head according to the present invention mounted over the dispensing nozzle of a shaving foam can.
Figure 2:
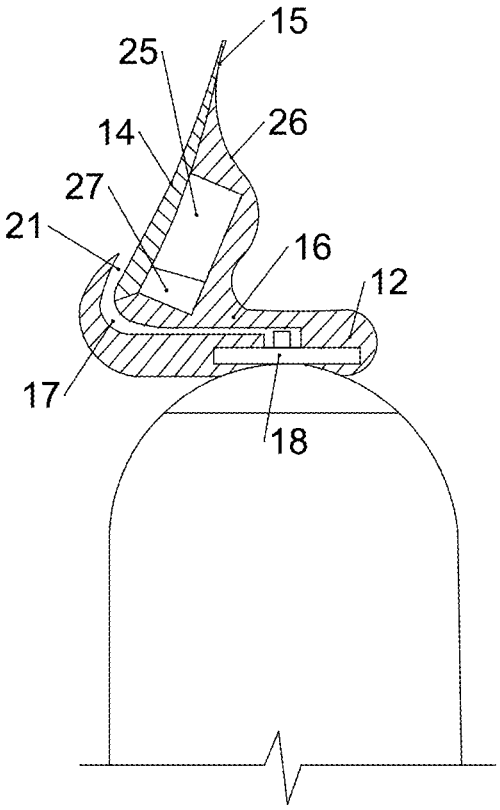
FIG. 2 is a cross sectional view of the dispensing head according to the present invention mounted over the dispensing nozzle of a shaving foam can.

In FIGS. 1 and 2, the head is attached over the top of the can with the valve for releasing the foam being omitted. It will be appreciated that various designs of nozzle and valve are provided in practice so that the particular arrangement of the mounting can be selected to match specific can designs. The valve can be operated by pressure through the mounting as the head is typically of a resilient material.

The dispensing head 10 includes:

an attachment portion 12 for engaging onto the source;

a blade portion 13 having a flexible blade 14 with a spreading surface with an outer spreading edge 15;

a mounting 16 connecting the attachment portion 12 and the blade portion 14;

a dispensing channel 17 in the head for communicating the foam from the can nozzle 18 to the spreading surface 14 of the blade portion so that the foam is applied onto the spreading surface 14 for spreading between the spreading surface 14 and the face or skin and for release from the spreading edge 15; and a vibration motor 19 for vibrating the spreading surface 14 and the spreading edge 15 to assist in spreading the foam as the spreading surface is moved over the face.

The spreading surface 14 is concave so that the foam is discharged onto the concave surface with the foam being received in the concave recess between the face and the surface defined by pressing the edge 15 against the face.

Typically a quantity of the foam is applied onto spreading surface which can then be applied over the whole area to be shaved.

The spreading surface 14 has an inner edge 20 and defines a continuous smooth surface extending from the inner edge 20 outwardly to the outer spreading edge 15. In this way the foam is discharged onto the spreading surface 14 through a slot 21 at a position adjacent the inner edge. The slot extends across the inner edge so as to direct the foam across the width of the surface to move from the inner slot across the whole width outwardly to the outer spreading edge 15.

The spreading surface includes a row 22 of dimples 23 adjacent the spreading edge 15 to hold the spreading surface 14 away from the face and thus form a thin layer of foam between the surface and the face to be applied to the face at the dimples.

The dispensing surface is generally fan shaped with side edges 24, 24A extending outwardly from an inner edge 20 at the slot 21 adjacent the channel to the arcuate outer edge at the spreading edge 15.

The vibration motor 19 is located within a chamber 25 formed in the body of flexible material behind the dispensing surface and includes charging terminals 26 for recharging a battery of the vibration motor.

A heater 27 for applying heat to the foam prior to application to the skin of the user can be provided and this is preferably located on the blade portion at or adjacent the vibration motor 19 in the chamber 25 for applying heat to the foam prior to or simultaneously with application to the skin of the user. The heater is a resistance heater driven by a battery which can optionally be the same battery as drives the vibration motor. Suitable switches (not shown) can be provided at the body of the flexible material for actuating the vibration and/or the heating.

Figure 3:
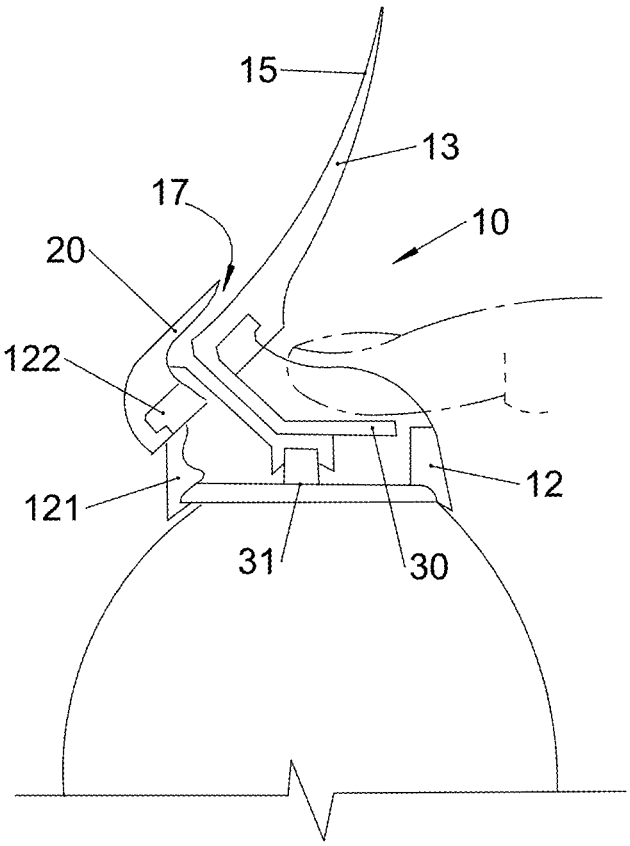
FIG. 3 is a further cross sectional view of the dispensing head according to the present invention mounted over the dispensing nozzle of a shaving foam can.

In FIG. 3 showing a further cross sectional view of the dispensing head, a trigger 30 is shown in the attachment portion 12 which connects to or engages the dispensing nozzle 31 of the can. The trigger is operable by the finger of the user reaching into an open area of the attachment portion. The attachment portion is formed as a separate component 121 from the spreading portion so that the flexibility of the two components can be controlled to meet the attachment requirements of the attachment portion 121 and the flexing requirements of the flexible blade 13. This therefore requires a connection 122 between the attachment portion and the spreading portion. In this embodiment, the vibration motor is omitted so that the spreading effect is obtained by the flexibility of the spreading blade. In this embodiment the dimples are also omitted.

Figure 4:
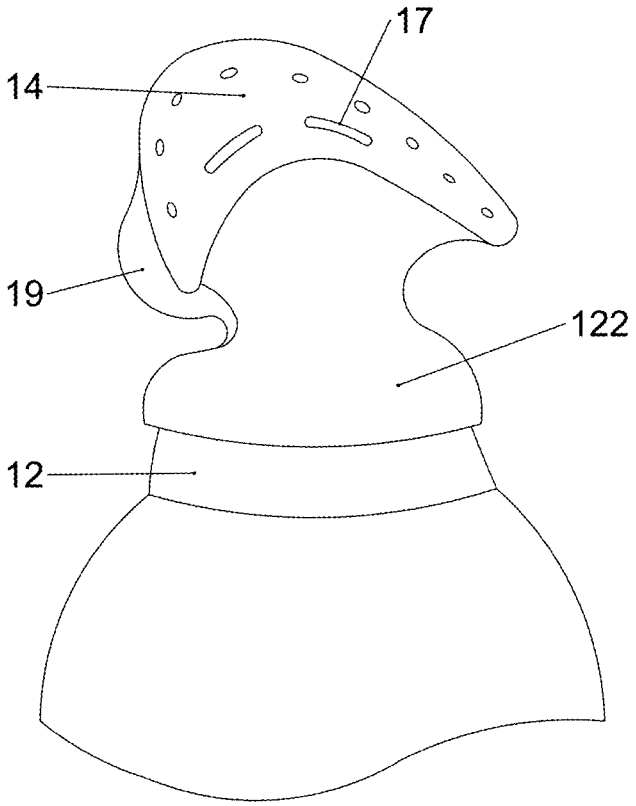
FIG. 4 is an isometric view of the dispensing head according to the present invention mounted over the dispensing nozzle of a source of gel.

FIG. 4 is an isometric view of the dispensing head according to the present invention mounted over the dispensing nozzle of a source of gel. As gel is of smaller volume when applied, the size of the spreading blade 14 is reduced to accommodate the smaller dose.

Figure 5:
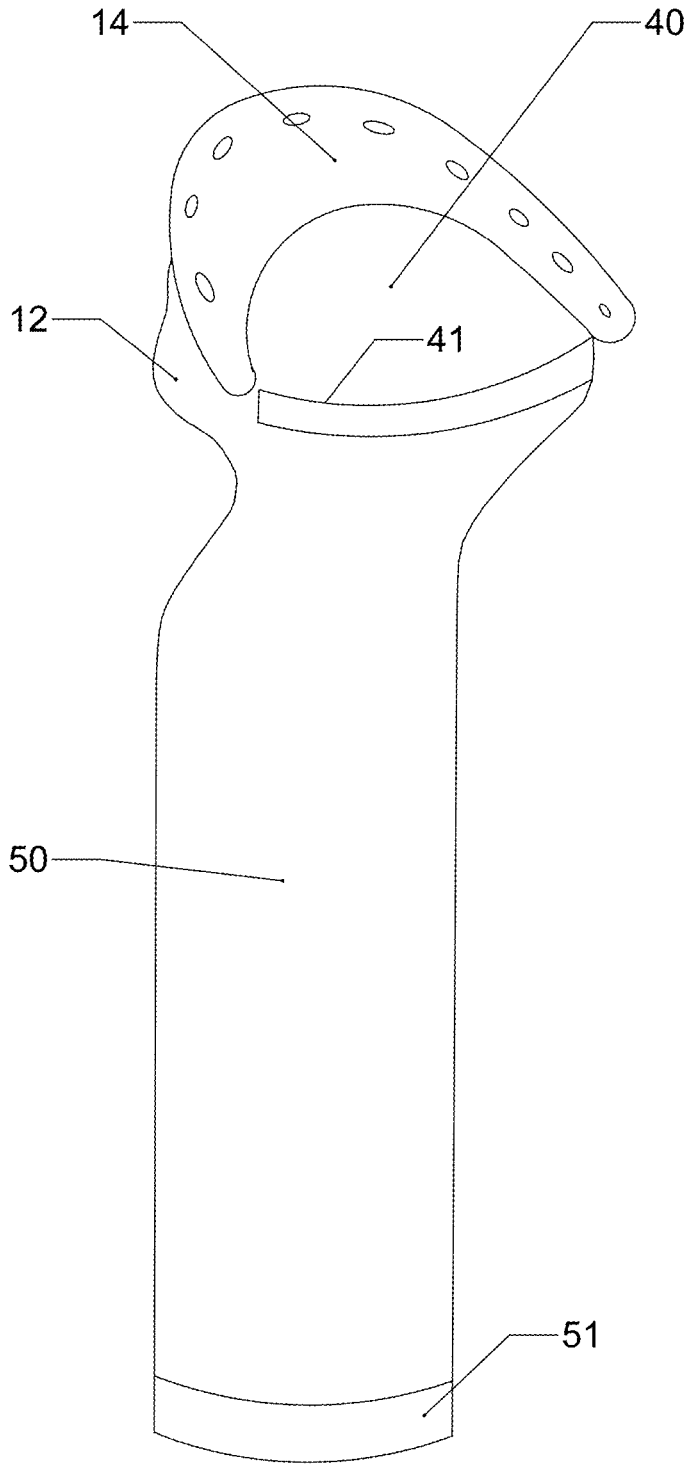
FIG. 5 is an isometric view of the dispensing head arranged for use with a pad of shaving lotion.
Figure 6:
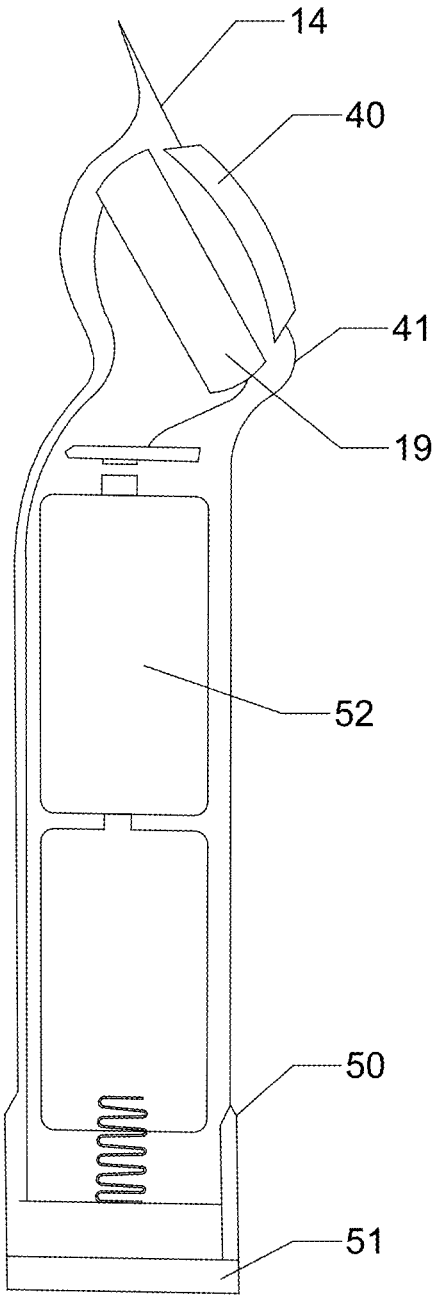
FIG. 6 is a cross sectional view of the dispensing head of FIG. 5.

FIGS. 5 and 6 shows an arrangement of the dispensing head for use with a pad 40 of shaving lotion. This arrangement requires the use of the vibration motor 19 behind the pad to assist in movement of the pad on the face to release the lotion. Thus the pad 40 is received in a surrounding recess 41 in the spreading portion. In this embodiment the vibration motor 19 is driven by a power supply 52 inside a housing 50 which is cylindrical to be grasped by the hand of the user with a base 51 acting as a switch. The power supply 52 can be optionally rechargeable or replaceable.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A dispensing head for application of shave lubricating material to the skin of a user prior to shaving, the dispensing head comprising:

a spreading blade portion;

the spreading blade portion having a flexible blade extending from an inner edge of the flexible blade to an outer spreading edge of the flexible blade;

wherein the flexible blade is formed from an integral body of flexible material which allows flexing of the outer spreading edge relative to the inner edge;

wherein the flexible blade has side edges diverging outwardly from the inner edge to the outer spreading edge;

wherein the outer spreading edge defines an arcuate shape which has a greater distance from the inner edge to the outer spreading edge at a location between the side edges than a distance from the inner edge to the outer spreading edge at the side edges;

wherein the flexible blade has a spreading surface on one face of the flexible blade extending between the inner edge and the outer spreading edge which is concave;

a source of the shave lubricating material for communicating the shave lubricating material to the spreading surface of the flexible blade so that the shave lubricating material is located on the spreading surface at a position spaced from the spreading edge for spreading between the spreading surface and the skin and for release from the spreading edge;

and at least one port for communicating the shave lubricating material to the spreading surface of the flexible blade where said at least one port is located at the inner edge.

2. The dispensing head according to claim 1 wherein the spreading surface includes a row of dimples at or adjacent the outer spreading edge to hold the spreading surface away from the skin and thus form a layer of the shave lubricating material to be applied to the skin at the dimples.

3. The dispensing head according to claim 1 wherein the source of shave lubricating material comprises a can having a dispensing nozzle and actuating valve for discharging the shave lubricating material through the nozzle and wherein the dispensing head includes an attachment portion arranged to engage onto the can at the nozzle to receive the shave lubricating material into the channel and to allow access to the valve for manual operation.

4. The dispensing head according to claim 1 including a vibration motor for vibrating the spreading surface and the outer spreading edge thereon to assist in spreading the shave lubricating material as the spreading surface is moved over the skin.

5. The dispensing head according to claim 4 wherein the vibration motor is located behind the spreading surface.

6. The dispensing head according to claim 4 wherein the vibration motor is encased in an enclosure in the spreading blade portion.

7. The dispensing head according to claim 4 wherein the spreading blade portion includes charging terminals for recharging a battery of the vibration motor.

8. The dispensing head according to claim 1 wherein there is provided a heater on the spreading blade portion for applying heat to the shave lubricating material prior to or simultaneously with application to the skin of the user.

9. A dispensing head for application of shave lubricating material to the skin of a user prior to shaving, the dispensing head comprising:

a spreading blade portion;

the spreading blade portion having a flexible blade with a concave spreading surface on one side of the flexible blade and with an outer spreading edge;

a source of the shave lubricating material for communicating the shave lubricating material to the spreading surface of the flexible blade so that the shave lubricating material is located on the spreading surface at a position spaced from the spreading edge for spreading between the spreading surface and the skin and for release from the spreading edge;

wherein the source of the shave lubricating material comprises a pad of the shave lubricating lotion mounted on the spreading blade portion.

10. The dispensing head according to claim 9 wherein;

the flexible blade is formed from an integral body of flexible material which allows flexing of the outer spreading edge relative to the inner edge;

the flexible blade has side edges diverging outwardly from the inner edge to the outer spreading edge;

the outer spreading edge defines an arcuate shape which has a greater distance from the inner edge to the outer spreading edge at a location between the side edges than a distance from the inner edge to the outer spreading edge at the side edges;

the flexible blade has a spreading surface on one face of the flexible blade extending between the inner edge and the outer spreading edge which is concave;

and the pad of the shave lubricating lotion is located at the inner edge.

11. A dispensing head for application of shave lubricating material to the skin of a user prior to shaving, the dispensing head comprising:

a spreading blade portion;

the spreading blade portion having a flexible blade with a concave spreading surface on one side of the flexible blade and with an outer spreading edge;

a pad of shave lubricating lotion mounted on the spreading blade portion;

and a vibration motor for vibrating the spreading surface and the spreading edge thereon to assist in spreading the shave lubricating lotion as the spreading surface is moved over the skin.

12. The dispensing head according to claim 11 wherein the vibration motor is located behind the spreading surface.

13. The dispensing head according to claim 11 wherein the vibration motor is encased in an enclosure in the spreading blade portion.

14. The dispensing head according to claim 11 wherein;

the flexible blade is formed from an integral body of flexible material which allows flexing of the outer spreading edge relative to the inner edge;

the flexible blade has side edges diverging outwardly from the inner edge to the outer spreading edge;

the outer spreading edge defines an arcuate shape which has a greater distance from the inner edge to the outer spreading edge at a location between the side edges than a distance from the inner edge to the outer spreading edge at the side edges;

the flexible blade has a spreading surface on one face of the flexible blade extending between the inner edge and the outer spreading edge which is concave;

and the pad of the shave lubricating lotion is located at the inner edge.

15. A dispensing head for attachment to a source of shave lubricating material for application of the shave lubricating material to the skin of a user, the dispensing head comprising:

an attachment portion for engaging onto the source;

a blade portion having a flexible blade with a spreading surface with an outer spreading edge;

a mounting connecting the attachment portion and the blade portion;

a dispensing channel in the head for communicating the shave lubricating material from the source to the spreading surface of the blade portion so that the shave lubricating material is applied onto the spreading surface for spreading between the spreading surface and the skin and for release from the spreading edge; and a vibration motor for vibrating the spreading surface and the spreading edge thereon to assist in spreading the shave lubricating material as the spreading surface is moved over the skin.

16. The dispensing head according to claim 15 wherein;

the flexible blade is formed from an integral body of flexible material which allows flexing of the outer spreading edge relative to the inner edge;

the flexible blade has side edges diverging outwardly from the inner edge to the outer spreading edge;

the outer spreading edge defines an arcuate shape which has a greater distance from the inner edge to the outer spreading edge at a location between the side edges than a distance from the inner edge to the outer spreading edge at the side edges;

the flexible blade has a spreading surface on one face of the flexible blade extending between the inner edge and the outer spreading edge which is concave;

and the pad of the shave lubricating lotion is located at the inner edge.

17. The dispensing head according to claim 15 wherein the vibration motor is located behind the spreading surface.

18. The dispensing head according to claim 15 wherein the vibration motor is encased in an enclosure in the spreading blade portion.

* * * * *